US008038149B2

(12) United States Patent
Trudeau et al.

(10) Patent No.: US 8,038,149 B2
(45) Date of Patent: Oct. 18, 2011

(54) ALIGNMENT/REGISTRATION AND CONVEYANCE APPARATUS

(75) Inventors: Joseph A. Trudeau, Watertown, CT (US); Karel J. Janatka, Southbury, CT (US); Edward M. Ifkovits, New Fairfield, CT (US); Russell W. Holbrook, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 220 days.

(21) Appl. No.: 12/241,573

(22) Filed: Sep. 30, 2008

(65) Prior Publication Data

US 2010/0078880 A1 Apr. 1, 2010

(51) Int. Cl.
*B65H 9/16* (2006.01)

(52) U.S. Cl. ..... 271/248; 271/250

(58) Field of Classification Search ..... 271/248–253
See application file for complete search history.

(56) References Cited

U.S. PATENT DOCUMENTS 387,112 A * 7/1888 Sedgwick ..... 271/251
2,155,553 A * 4/1939 Jones ..... 271/250
4,527,792 A * 7/1985 Burkhardt ..... 271/225
5,224,696 A * 7/1993 Kellum, III ..... 271/184
5,613,674 A * 3/1997 Golicz et al. ..... 271/250
5,779,236 A * 7/1998 Duncan et al. ..... 271/276
7,028,450 B2 * 4/2006 Hart et al. ..... 53/532

* cited by examiner

*Primary Examiner* — Stefanos Karmis
*Assistant Examiner* — Thomas Morrison
(74) *Attorney, Agent, or Firm* — Brian A. Collins; Charles R. Malandra, Jr.; Steven J. Shapiro

(57) ABSTRACT

An apparatus for registering sheet material while being conveyed along a feed path including: (i) a conveyance deck for conveying sheet material along a support surface, (ii) a registration member defining an abutment surface operative to align an edge of the sheet material as the sheet material is conveyed along the support surface of the conveyance deck, and (iii) a drive mechanism disposed adjacent to the registration member and along the conveyance deck. The drive mechanism includes a flexible belt disposed about and supported by at least two rolling elements, and a means for driving the flexible belt about the rolling elements. The flexible belt includes a twisted section defining a plurality of spiral edge segments operative to (i) frictionally engage a surface of the sheet material to urge the sheet material against the abutment surface and (ii) convey the sheet material along the conveyance deck.

16 Claims, 7 Drawing Sheets

ALIGNMENT/REGISTRATION AND CONVEYANCE APPARATUS

TECHNICAL FIELD

This invention relates to an apparatus for aligning/registering and conveying sheet material, and more particularly, to a new and useful apparatus for aligning/registering an edge of the sheet material against an abutment surface and rapidly conveying the same along a primary feed path.

BACKGROUND ART

Sheet material/mailpiece handling systems frequently require sheet material, assembled/folded collations or completed mailpieces (hereinafter collectively referred to as "sheet material") to be turned over to match a specific downstream requirement. For example, mailpiece fabrication equipment typically requires that sheet material be oriented face-up or face down depending upon the orientation of a receiving envelope. This requirement has come under increasing demand as new and old equipment have, over the course of time, been merged. That is, some mailpiece fabrication systems require a face-up orientation while others employ a face-down presentation. Additionally, it may be necessary to change the orientation of a mailpiece to accommodate a specific printing requirement, i.e., printing on a particular side of an envelope.

Various inversion modules have been developed to reorient sheet material for use in sheet handling equipment. One such apparatus is a twist module wherein sheet material is directed linearly along a spiral path typically effected by a series of twisted belts or chords. While such twist modules retain the respective leading and trailing edge position of the sheet material, such modules require a lengthy axial path to change the face-up/face-down orientation of the sheet material. Furthermore, twist modules are less reliable when handling stacked collations inasmuch as the stacked sheets tend to skew as they follow the spiral path.

Another common requirement is for the sheet material to be re-directed at a right angle from an upstream feed path to be processed along another feed path, out-sorted or stacked in a sorting bin. For example, a mailpiece inserter will frequently employ modules for re-directing the feed path to accommodate the configuration of a customers facility. Additionally, it may be desirable to re-direct completed mailpieces ninety-degrees from the primary feed path to stack or out-sort mailpieces in a bin, tray or container disposed laterally of the primary feed path.

Yet another requirement relates to the registration and conveyance of the sheet material after the sheet material has been handled or in preparation for a subsequent downstream operation. For example, sheet material will may skew during handling, e.g., as the orientation changes, and, as such, correction may be required. Commonly, such correction is effected by urging the sheet material against a shoulder or wall to register the individual sheets, or square the leading and trailing edges of a mailpiece relative to the primary feed path. This is typically achieved by a series of banked rollers arranged so as to define a shallow angle relative to the feed path and the registration wall. The shallow angle functions to impart components of velocity, i.e., to the sheet material, in two directions—a primary velocity component along the feed path and a secondary velocity component toward the registration wall.

While this arrangement is well-suited for sheet material travelling along the primary feed path, i.e., substantially parallel to the primary velocity component produced by the banked rollers, such arrangement is less effective, or entirely ineffective, should the sheet material enter at a more aggressive angle, e.g., ninety-degrees. That is, the orientation of the banked rollers can inhibit the smooth transition of the sheet material to the primary feed path.

Furthermore, inasmuch as the banked rollers drive the sheet material as a function of the friction developed by, or under the weight of, the sheet material, it can be difficult to accelerate the sheet material to the full inserter throughput speed. For example, when sheet material enters the banked rollers, the sheet material may have no initial velocity in the direction of the primary feed path. Consequently, the sheet material must be rapidly accelerated, i.e., from zero velocity to the full inserter throughput speed, to prevent upstream sheet material from interfering or colliding with the downstream material. Difficulties can arise when friction forces developed between the sheet material and banked rollers are low, and, accordingly, the banked rollers do not develop sufficient traction to adequately/rapidly accelerate the sheet material.

A need, therefore, an apparatus which satisfies a requirement to rapidly accelerate sheet material along a feed path while effecting registration of the sheet material during conveyance.

BRIEF DESCRIPTION OF THE DRAWINGS

The accompanying drawings illustrate presently preferred embodiments of the invention and, together with the general description given above and the detailed description given below serve to explain the principles of the invention. As shown throughout the drawings, like reference numerals designate like or corresponding parts.

The invention will be fully understood when reference is made to the following detailed description taken in conjunction with the accompanying drawings.

SUMMARY OF THE INVENTION

An apparatus is provided for registering sheet material while being conveyed along a feed path. The apparatus includes: (i) a conveyance deck for conveying sheet material along a support surface, (ii) a registration member disposed adjacent the conveyance deck and defining an abutment surface operative to align an edge of the sheet material as the sheet material is conveyed along the support surface of the conveyance deck, and (iii) a drive mechanism disposed adjacent to the registration member and along the conveyance deck. The drive mechanism includes at least two rolling elements, a continuous flexible belt disposed about and supported by rolling elements, and a means for driving the flexible belt about the rolling elements. The flexible belt includes a section which extends along the feed path and which is twisted about an elongate axis of the flexible belt. The twisted belt section defines a plurality of spiral edge segments operative to: (i) frictionally engage a surface of the sheet material to urge the sheet material against the abutment surface, and (ii) convey the sheet material along the support surface of the conveyance deck.

DETAILED DESCRIPTION

An apparatus for handling sheet material is described in the context of a mailpiece fabrication system wherein sheet material is handled and inserted into an envelope or pocket for mailing. It should be appreciated, however, that the apparatus disclosed herein may be employed in any material handling system wherein the orientation of the sheet material is necessary for use in various subsystems/steps of the fabrication process. The embodiments disclosed herein, therefore, are merely illustrative of the inventive teachings and should not be construed as limiting the invention as described in the specification and appended claims.

Figure 1:
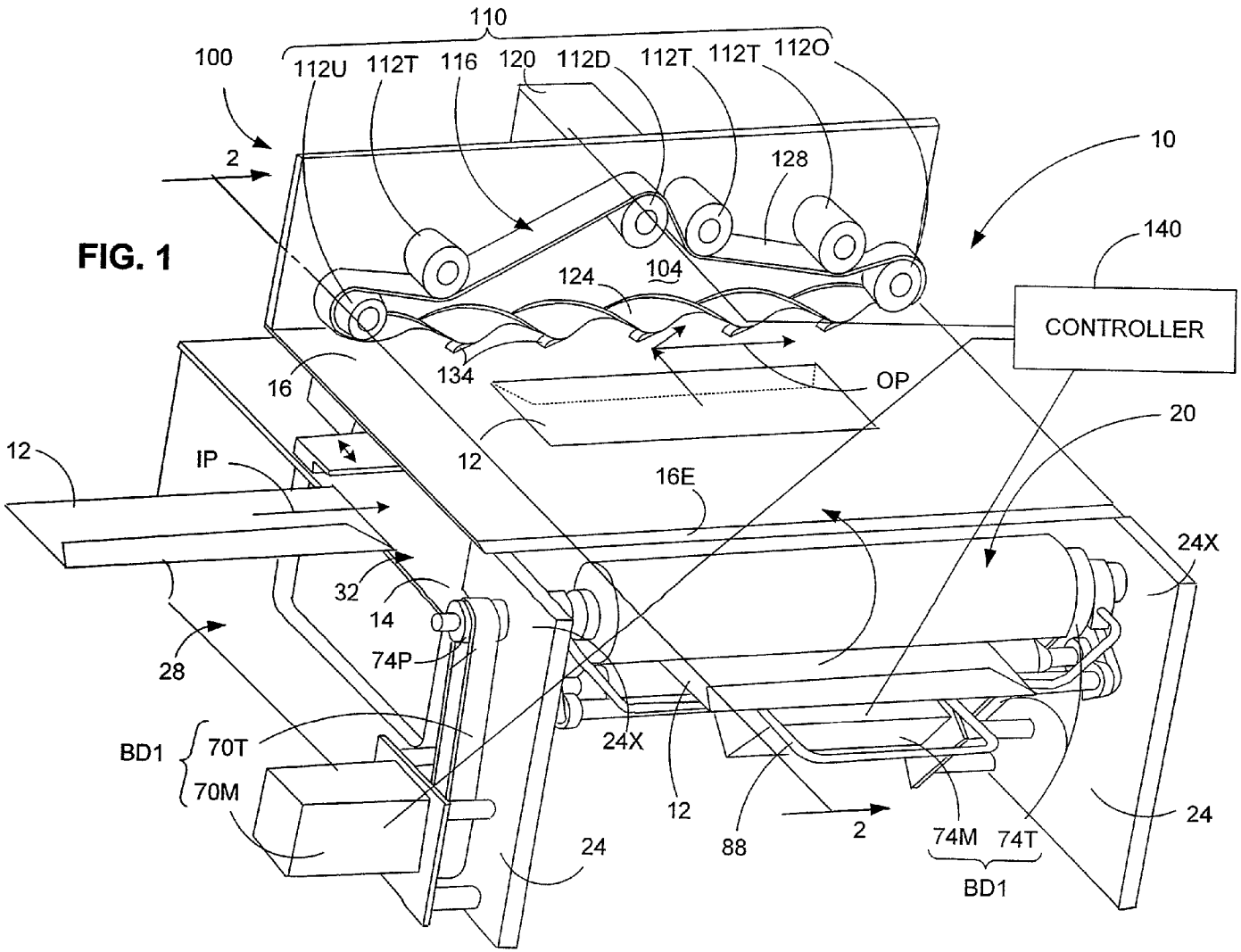
FIG. 1 is a perspective view of an apparatus for altering the orientation and/or direction of sheet material including a registration/conveyance device according to the present invention.

In FIG. 1, a perspective view is provided of an apparatus 10 for altering the orientation and/or direction of a sheet material. In the illustrated embodiment, the sheet material is a mailpiece envelope 12 which is inverted from a face-down to a face-up orientation for subsequent processing, e.g., printing a postage indicia on the upper face of the mailpiece envelope. Consequently, where appropriate, the term "mailpiece envelope" may be substituted for, or used interchangeably with, the term "sheet material" throughout the description. Notwithstanding the descriptive term used, the scope of the appended claims is directed to the broader application associated with inverting and re-directing sheet material.

Figure 2:
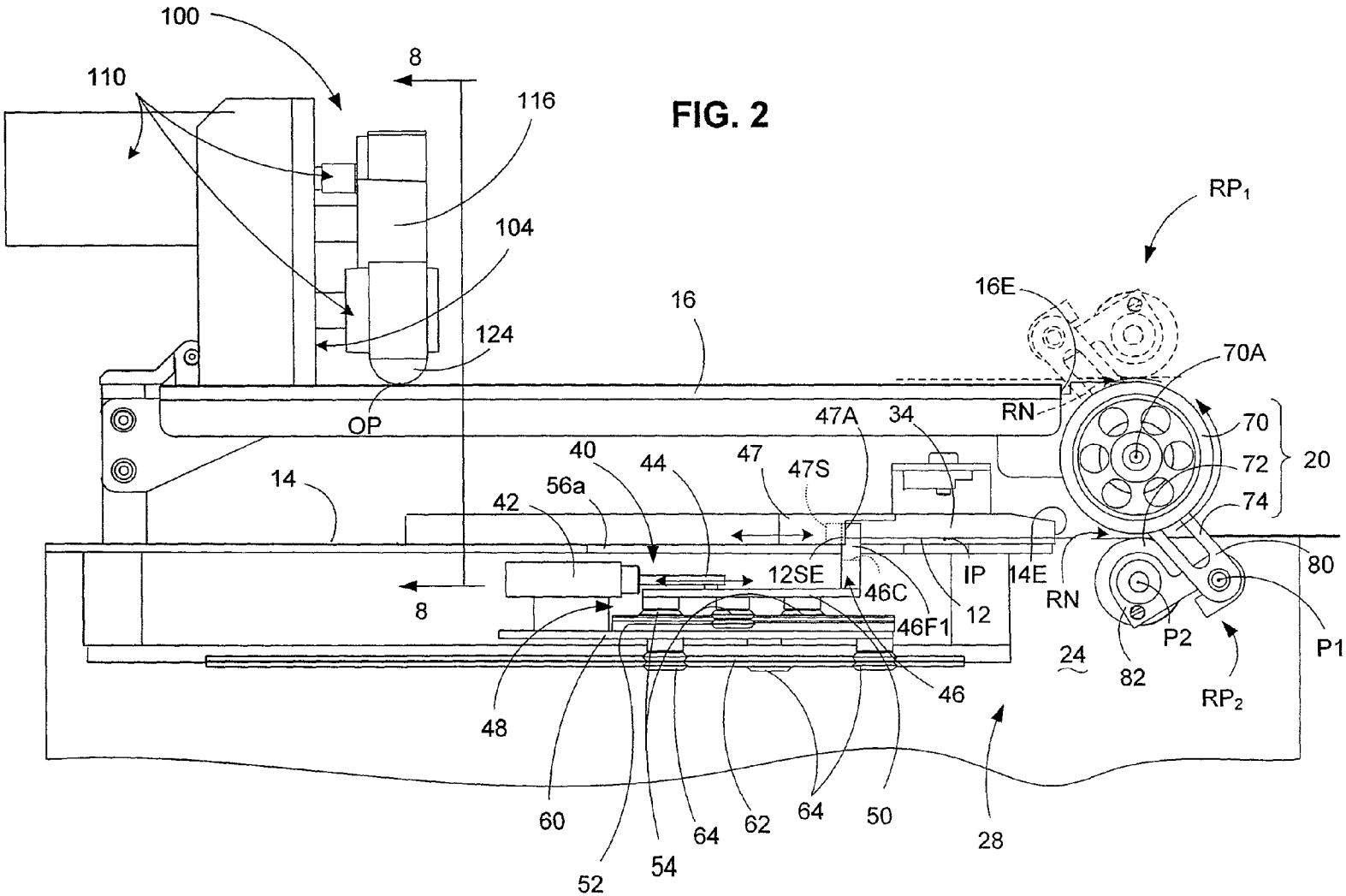
FIG. 2 is a cross-section taken substantially along line 2-2 of FIG. 1, including an actuation mechanism for diverting the mailpiece from an input feed path to an orbit nip roller assembly operative to invert the orientation of the sheet material.

In FIGS. 1, and 2 the apparatus 10 includes an input deck 14 for accepting sheet material along an input feed path (depicted as a point IP extending into the page in FIG. 2), an output conveyance deck 16 for dispensing sheet material along an output feed path (depicted as a point OP extending into the page in FIG. 2), and an orbit nip roller assembly 20 operative invert the mailpiece 12 by rotationally displacing the mailpiece 12 from the input deck 14 to the output conveyance deck 16. The orbit nip roller assembly 20 is aligned with, and adjacent to, an edge 14E, 16E of the input and output conveyance decks 14, 16 and includes a roller nip RN which is bi-directionally displaced, through an arc, from a first radial position $RP_1$ to a second radial position $RP_2$ (see FIG. 2) In the first radial position $RP_1$, the roller nip 22 is adapted to accept sheet material 12 from the input deck 14 at a substantially right angle relative to the input feed path IP. In the second radial position $RP_2$, the roller nip 22 is adapted to dispense sheet material 12 to the output conveyance deck 16 at a substantially right angle relative to the output feed path OP.

In the illustrated embodiment, the input and output conveyance decks 14, 16 are integrated by sidewall structures 24 of a housing 28 such that the decks 14, 16 are substantially parallel, and vertically-spaced or tiered with respect to each other. While the illustrated embodiment depicts the output conveyance deck 16 as being elevated vertically above the input deck 14, it will be appreciated that, with certain structural modifications, the location of the decks 14, 16 could be reversed, i.e., the input deck 14 could be disposed above the output conveyance deck 16.

To accommodate the receipt and alignment of a mailpiece 12, an opening 32 is provided between the decks 14, 16 and an abutment surface 34 is provided at a far end of the input deck 14, i.e., at a location sufficiently inboard of the opening 32, to stop the forward progress of a mailpiece along the input feed path IP. The abutment surface 34, furthermore, is positioned so as to accommodate the full length of the largest mailpiece 12, i.e., the length of the largest mailpiece anticipated to be handled/processed by the apparatus 10. While not shown in the perspective and profile views of FIGS. 1 and 2, an input conveyance device, e.g., a conventional belt conveyance system, is provided at the entrance of the opening 32 to deliver mailpieces 12 to the input deck 14.

Once the mailpiece 12 has entered the apparatus 10 and comes to rest against the abutment surface 34, an actuation mechanism 40 (see FIG. 2) engages a side edge 12SE of the mailpiece 12 to urge the mailpiece 12 toward the orbit nip roller assembly 20. More specifically, the actuation mechanism 40, discussed in greater detail below, is operative to displace the mailpiece 12 at a substantially right angle with respect to the input feed path IP, toward the orbit nip roller assembly 20. In the context used herein, "a substantially right angle" means that the mailpiece is re-directed within a range of about eighty degrees (80°) to about one-hundred degrees (100°) relative to the input feed path IP.

Actuation Mechanism

Figure 3:
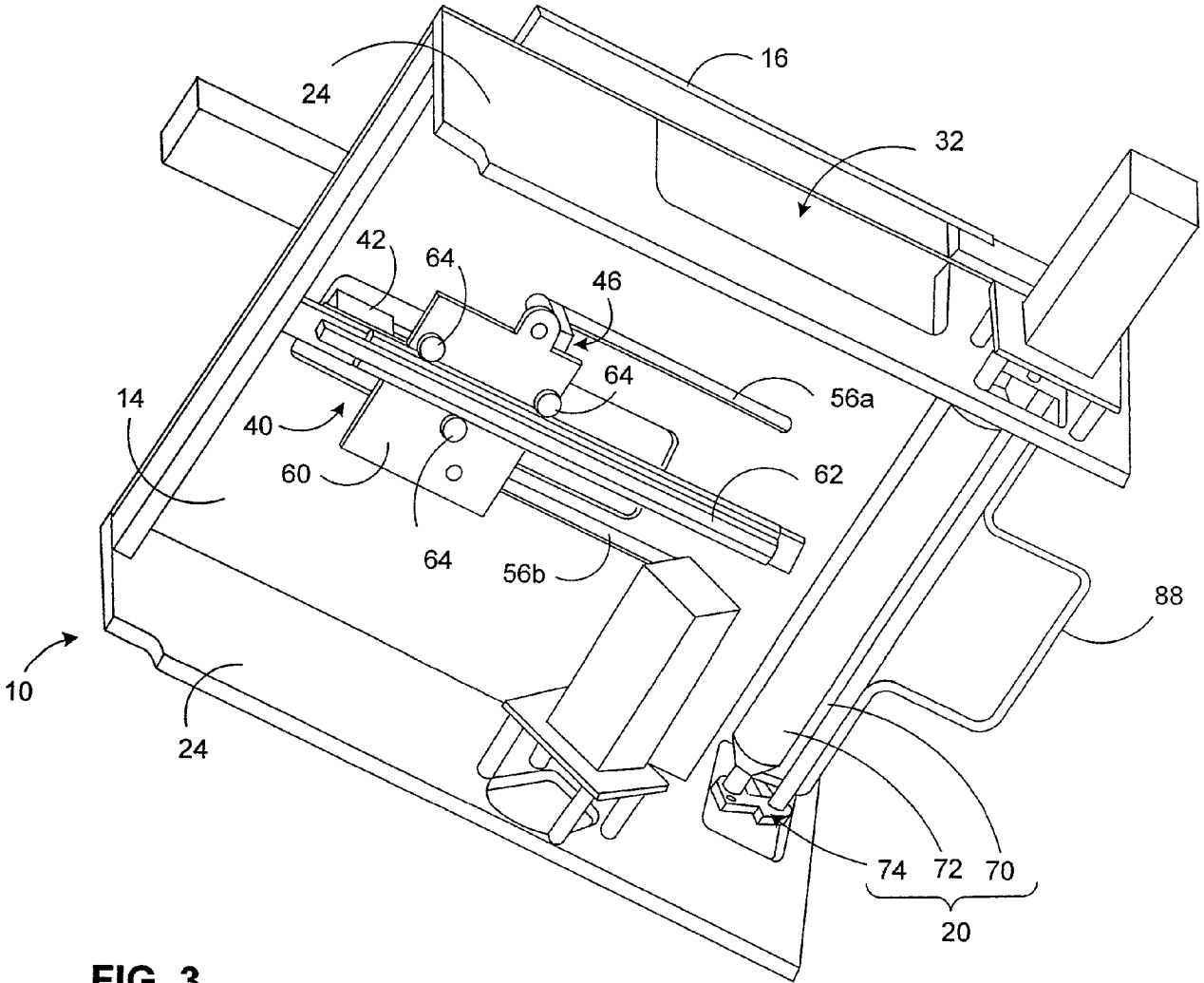
FIG. 3 is a bottom perspective view of the sheet inverting apparatus.

In FIGS. 2 and 3, the actuation mechanism 40 includes a Linear Variable Displacement Transducer (LVDT) 42 having an actuation shaft 44 which may be displaced toward and away from the orbit nip roller assembly 20, a pusher bar 46 operatively coupled to the actuation shaft 44, and a guide assembly 48 coupled to and guiding the pusher bar 46. The pusher bar 46 includes a crossbar 46C (see FIG. 8) and a pair of fingers 46F1, 46F2 which project vertically from the cross bar 46C, i.e., one of the fingers 46F1, 46F2 at each end of the crossbar 46C. Moreover, the fingers 46F1, 46F2 are integrated with an elongate L-shaped guide 47 which includes a slot 47S for accepting each of the fingers 46F1, 46F2. Once a mailpiece 12 has entered, and is at rest within, the input deck 14, the fingers 46F1, 46F2 of the pusher bar 46 lie adjacent to a side edge 12SE of the mailpiece 12 and, as such, the fingers 46F1, 46F2 are prepositioned within the slots 47S to urge the mailpiece 12 into the roller nip RN of the orbit nip roller assembly 20. The operation of the actuation mechanism 40 and the pusher fingers 46F1, 46F2 will become apparent in light of the following description.

The guide assembly 48 is disposed along the underside of the input deck 14 and includes: (i) a connecting plate 50, (ii) a guide rail 52, (iii) a plurality of guide wheels 54 rotationally mounted to the connecting plate 50 and engaging the guide rail 52, and (iv) a pair of elongate slots 56*a*, 56*b* formed through the input deck 14. More specifically, the connecting plate 50 is: (i) coupled to the actuation shaft 44 at one end, (ii) affixed to the pusher bar 46 at the opposite end, and (iii) guided linearly along the guide rail 52. Additionally, the fingers 46F1, 46F2 of the pusher bar 46 extend vertically through the elongate slots 56*a*, 56*b* and seat within the slots 47S of the guide 47. Furthermore, the fingers 46F1, 46F2 are aligned, or flush with, the guide abutment surface 47A of the L-shaped guide 47 to allow mailpieces 12 to enter the input deck 14 without contacting the fingers 46F1, 46F2 of the pusher bar 46. The guide wheels 54 are disposed to each side of the guide rail 52 and are operative to guide the connecting plate 50 along the guide rail 52.

Inasmuch as the fingers 46F1, 46F2 of the pusher bar 46 are coupled to the connecting plate 50 by the crossbar 46C, the motion of the actuating shaft 44 and connecting plate 50 is transferred to the fingers 46F1, 46F2 of the pusher bar 46. More specifically, the actuating shaft 44 is displaced by the LVDT actuator 42 and transfers motion to the connecting plate 50, As the connecting plate 50 moves, it is guided along the rail 62 by the guide wheels 54. The motion of the connecting plate 50 is transferred to the crossbar 46C and to the fingers 46F1, 46F2. The fingers 46F1, 46F2, slide and are guided within the elongate slots 56*a*, 56*b* of the input deck 14. Further, the fingers 46F1, 46F2, seat within the slots 47S of the guide 47 when the actuation mechanism 40 is in its ready or "home" position, i.e., waiting for the next mailpiece 12 to enter the input deck 14 along the input feed path IP. In the described embodiment, the stroke of the actuation shaft 44 and pusher bar 46 is less than one inch (1"), i.e., sufficient only to urge the mailpiece 12 into the roller nip 22 of the orbit nip roller assembly 20.

In the described embodiment, the location of the entire actuation mechanism 40 may be adjusted toward or away from the orbit nip roller assembly 20 to accommodate variable width mailpieces 12. More specifically, the actuation mechanism 40 is mounted to a base plate 60 which, similar to the connecting plate 50, is mounted to an elongate adjustment rail 62 (see FIG. 3) via a plurality of rolling wheels 64. To effect adjustment of the actuation mechanism 40, a set-screw or other locking device (not shown) is released to slide the actuation mechanism 40 along the adjustment rail 62 to the desired position. The same set-screw or locking device may then be re-set to lock the actuation mechanism 40 in its adjusted position.

Orbit Nip Roller Assembly

Figure 4:
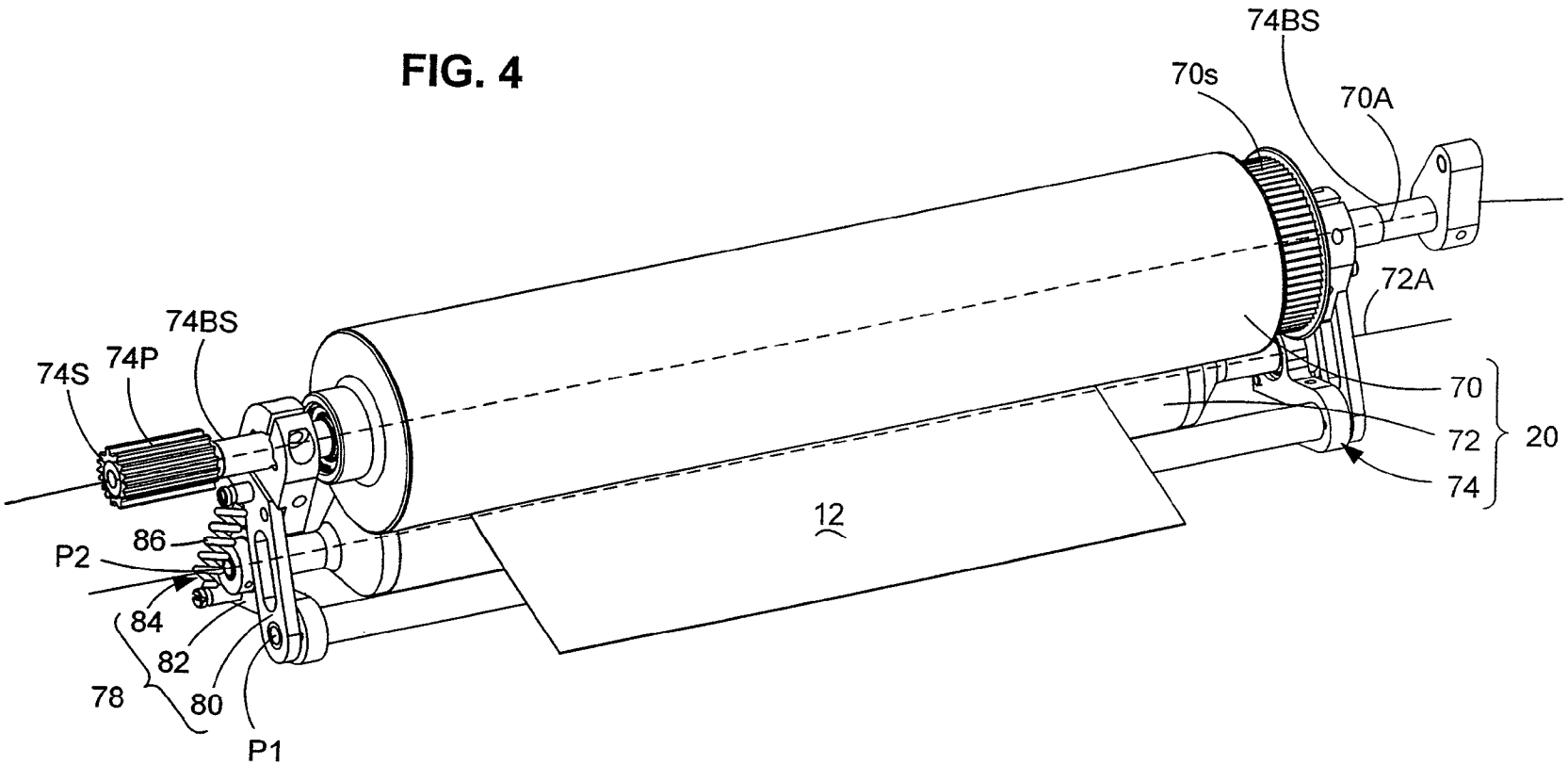
FIG. 4 is an isolated perspective view of the orbit nip roller assembly including a primary roller, a secondary roller and a carriage assembly for bi-directionally displacing the secondary roller in an arc about the rotational axis of the primary roller.
Figure 5:
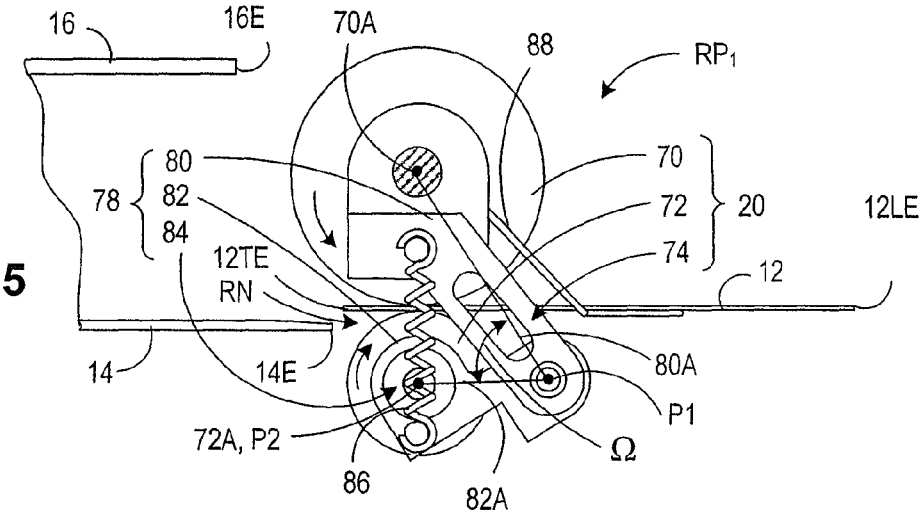
FIG. 5 depicts the orbit nip roller assembly in a first radial position wherein the primary and secondary rollers accept a mailpiece from the input deck.
Figure 6:
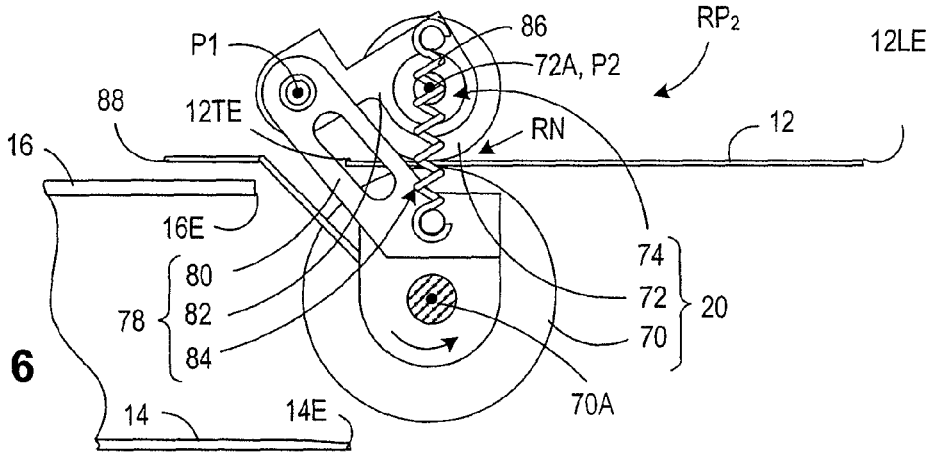
FIG. 6 depicts the orbit nip roller assembly in a second radial position wherein the mailpiece is dispensed from the roller nip to the output conveyance deck.
Figure 7:
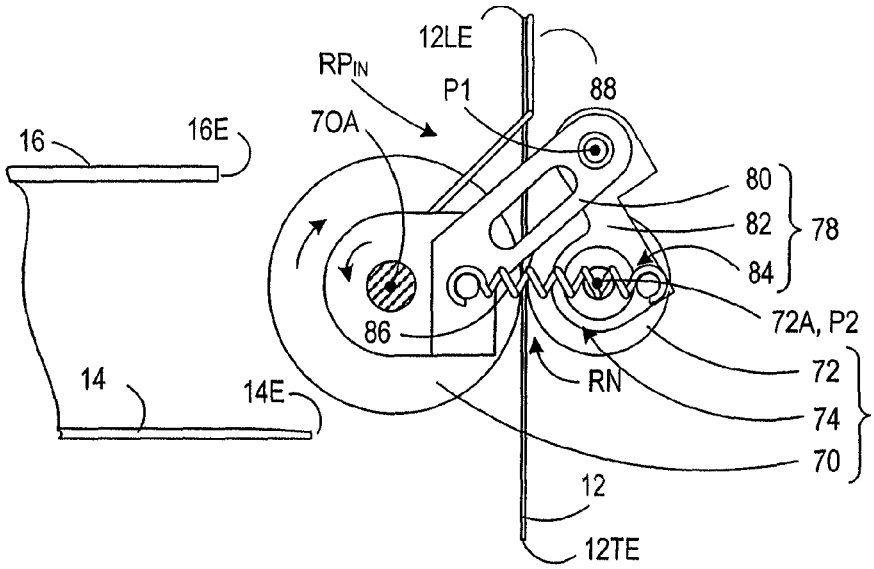
FIG. 7 depicts the orbit nip roller assembly in an intermediate radial position illustrating relative movement between the mailpiece and the roller nip as the secondary roller is displaced from the first to the second radial position.

An isolated perspective view of the roller nip assembly 20 is shown in FIG. 4 while FIGS. 5 through 7 depict the orbit nip roller assembly 20 in various operational positions. FIG. 5 depicts the orbit nip roller assembly 20 in a first radial position RP1 wherein a mailpiece enters a roller nip RN of the orbit nip roller assembly 20 from the input deck 14. FIG. 6 depicts the orbit nip roller assembly 20 in a second radial position RP2 wherein a mailpiece is dispensed from the roller nip RN to the output conveyance deck 16. FIG. 7 depicts the orbit nip roller assembly 20 at an intermediate radial position RPIN illustrating relative movement between the mailpiece 12 and the roller nip RN as the roller nip RN is displaced from the first to the second radial positions RP1, RP2. In FIGS. 4 and 5, the roller nip RN is substantially parallel to the input and output feed paths IP, OP such that, in the first radial position RP1, the roller nip RN accepts the mailpiece 12 from the input deck 14 at a substantially right angle with respect to the input feed path IP. Similarly, in the second radial position RP2 shown in FIG. 6, the roller nip RN dispenses the mailpiece 12 to the output conveyance deck 16 at a substantially right angle with respect to the output feed path OP.

In FIGS. 1, 2, 4 and 5, the orbit nip roller assembly 20 is operative to invert the mailpiece 12, e.g., from a face-down to a face-up orientation, and/or re-direct a mailpiece 12 at a right angle relative to the input feed path IP. More specifically, the orbit nip roller assembly 20 includes a primary roller 70, a secondary roller 72 disposed about the periphery of the primary roller 70, and a carriage assembly 74 operative to bi-directionally displace the secondary roller 72 about the periphery of the primary roller 70. The primary roller 70 rotates about a first axis of rotation 70A and mounts at each end to portions 24X of the sidewall structure 24 which extend outwardly beyond the edges 14E, 16E of the input and output conveyance decks 14, 16. The secondary roller 72 rotates about a second axis of rotation 72A and mounts to the carriage assembly 74 via a spring-biased scissors link assembly 78.

The scissors link assembly 78 (best seen in FIGS. 4 and 5) is operative to rotationally couple the rollers 70, 72 about their respective axes 70A, 72A and permits variable nip spacing, i.e., the gap between the primary and secondary rollers 70, 72, to accommodate mailpiece thickness variations. More specifically, the scissors link assembly 78 includes a first link 80, a second link 82 pivotally mounted to a first link 80 at a first pivot point P1, and a spring biasing mechanism 84 disposed between, and connected at each end to, one of the first and second links 80, 82. In the described embodiment, the first link 80 is fixedly mounted about the rotational axis 70A of the primary roller 70 while the second link 82 is pivotally mounted about the rotational axis 72A of the secondary roller 72 at a second pivot point P2. Furthermore, the first and second links 80, 82 each define an elongate axis 80A and 82A, respectively, which form an angle Ω therebetween.

The spring biasing mechanism 84 includes a tension spring 86 which is operative to rotationally bias the second link 82 about the first pivot point P1 toward the first link 80. Moreover, the tension spring 86 is operative to reduce or minimize the angle Ω between the elongate axes 80A, 82A of the first and second links 80, 82.

In operation, the first and second links 80, 82 are operative to expand or close the nip spacing between the primary and secondary rollers 70, 72 to accommodate mailpiece thickness variations. Specifically, the first and second links 80, 82 may pivot about the first pivot point P1 in either direction, i.e., increasing or decreasing the angle Ω between the links 80, 82. As a result, the spacing between the primary and secondary rollers 70, 72 varies to accept mailpieces having variable thickness. Furthermore, the coil spring 86 biases the second link 82 toward the first link 80, thereby minimizing the angle Ω between the links 80, 82. Consequently, the secondary roller 72 is biased toward the primary roller 70 to minimize the roller nip spacing while maintaining a positive clamping force on each mailpiece 12.

The primary roller 70 and carriage assembly 74 are driven by first and second belt drive assemblies, BD1 and BD2, respectively. The first belt drive assembly BD1 includes a first motor 70M (see FIG. 1) and a cogged timing belt 70T which drives a spur gear 70S (FIG. 4) disposed in combination with the primary roller 70. Specifically, the spur gear 70S is integrated with an internal cylinder (not shown) over which a high friction elastomer is molded to form the periphery of the primary roller 70.

The second belt drive assembly BD2 includes a second motor 74M (see FIG. 1) and a cogged timing belt 74T for driving a pinion gear 74P (see FIG. 4) disposed at the end of a drive shaft 74S. In the described embodiment, the drive shaft 74S is co-axially aligned with, and extends through, the internal cylinder of the primary roller 70 and includes bearing surfaces 74BS at each end thereof to rotationally mount the primary roller 70 to the sidewall structures 24 of the housing 28. While each of the drive assemblies BD1, BD2 is belt driven, it will be appreciated that the internal cylinder of the primary roller 70 and the drive shaft 74S of the carriage assembly 74 may be driven by any one of a variety of gear train or pulley drive systems.

In operation and referring to FIGS. 5 and 6, the orbit nip roller assembly 20 is adapted to receive mailpieces 12 from the input deck 14. That is, the secondary roller 72 is positioned relative to the primary roller 70 such that the roller nip RN is substantially coplanar with the input deck 14. To receive each mailpiece 12, the primary roller 70 is actively driven (i.e., by the first belt drive assembly BD1) while the secondary roller 72 passively rotates due to the friction generated at the roller nip RN (e.g. by the mailpiece 12).

In this first operational step, the primary roller 70 drives the mailpiece 12 outwardly away from the outboard edge 14E of the input deck 14. That is, the primary roller 70 displaces the mailpiece 12 such that a leading edge portion 12LE thereof extends beyond the roller nip RN and a trailing edge portion 12TE of the mailpiece is captured within the roller nip RN. In the described embodiment, a U-shaped guide rail 88 (best seen in FIG. 1) may be provided to support the extended portion of the mailpiece 12, i.e., the portion which extends outwardly of the roller nip RN. As such, the mailpiece 12 is: (i) supported at its leading edge by the guide rail 88, (ii) prepositioned to clear the outboard edge 14E of the input deck, and (iii) free to rotate about or with the primary roller 70.

In a next operational step, the carriage assembly 74 is driven about the rotational axis 70A of the primary roller 70. Consequently, the secondary roller 72 orbits the rotational axis 70A of the primary roller 70 from the first radial position RP1 (i.e., wherein the secondary roller 72 is positioned at about −90° relative to the input deck 14) to the second radial position RP2 (i.e., wherein the secondary roller 72 is positioned at about +90° relative to the output conveyance deck 16). As such, the mailpiece 12 is rotated approximately one-hundred and eighty degrees (180°) and inverted from a face-down orientation on the input deck 14 to a face-up orientation on the output conveyance deck 16.

Rotation of the orbit nip assembly 20 and inversion of the mailpiece 12 is achieved by controlling the rotary drive motors 70M, 74M associated with the primary roller 70 and carriage assembly 74. In one embodiment, the first belt drive assembly BD1 associated with primary roller 70 is driven while the carriage assembly 74 fixed for rotation with the primary roller 70. The carriage assembly 74, therefore, rotates with the primary roller 70 such that the secondary roller 72 merely follows the primary roller 70 about its periphery.

In another embodiment, the second belt drive assembly BD2 associated with the carriage assembly 74 may be driven to roll the secondary roller 72 over the mailpiece 12 and the periphery of the primary roller 70. As such, depending upon the width dimension of the mailpiece 12, the position of the mailpiece 12 relative to the roller nip RN will change, i.e., causing the roller nip RN to move closer to the leading edge of the mailpiece 12.

In yet another embodiment, it may be desirable to control the position of the mailpiece 12 relative to the roller nip RN such that the orbit nip roller assembly 20 may accelerate the mailpiece 12 toward the registration/conveyance apparatus 100 upon reaching the second radial position RP2. This may be required inasmuch as the output conveyance deck 16 must be sufficiently wide to process/handle mailpieces of varying width, i.e., from relatively small, type ten (10) envelopes to larger flats-type envelopes. Since larger envelopes nearly span the distance between orbit nip roller assembly 20 and the registration/conveyance apparatus 100, there is no requirement for an intermediate roller nip or drive device to convey larger mailpieces across the output conveyance deck 16. With respect to smaller envelopes, the orbit nip roller assembly 20 is operative to slide these mailpieces across the output conveyance deck 16 toward the registration/conveyance apparatus 100. This method of control is advantageous to avoid the cost and complexity associated with an intermediate roller nip or drive device.

To perform this operation successfully, the mailpiece 12 must be positioned within the roller nip RN such that primary and secondary rollers 70, 72 remain engaged with the mailpiece 12 for some minimum period of time. More specifically, the rotary drive motors 70M, 74M of the primary roller 70 and carriage assembly 74 are driven such that the trailing edge 12TE of the mailpiece 12 moves away from the roller nip RN and the leading edge of the mailpiece 12 moves toward the roller nip RN. This may be achieved by controlling the relative motion of the primary roller 70 with respect to the carriage assembly 74, such that the secondary roller 72 rotates over the mailpiece 12 while the primary roller 70 effectively rotates in a direction opposite to the secondary roller 72.

FIG. 7 shows the mailpiece 12 being repositioned within the roller nip RN at an intermediate radial position RPIN between the first and second radial positions RP1, RP2. Upon reaching the second radial position RP2, the mailpiece 12 has moved such that the roller nip RN is proximal to the leading edge 12LE rather than the trailing edge 12TE. It will be recalled that, the leading edge 12LE of the mailpiece 12 is moved away from the roller nip RN i.e., when the roller assembly 20 is in the first radial position RP1 (FIG. 5), to avoid contact with the input deck 14 as the mailpiece 12 rotates with, and is inverted by, the roller assembly 20. By controlling the orbit nip roller assembly 20 in this manner, the roller nip RN is positioned relative to the mailpiece 12 such that the contact length between the rollers 70, 72 and the mailpiece 12 is sufficient achieve the requisite acceleration/momentum to slide the mailpiece 12 across the output conveyance deck 16 to the registration/conveyance apparatus 100.

While the orbit nip roller assembly 20 is principally employed to invert mailpieces 12 as they are received/dispensed from the input to output conveyance decks 14, 16, it will be appreciated that the orbit nip roller assembly 20 may be used passively to re-direct a mailpiece 12 at a right angle to another processing module, bin and/or container. That is, should a mailpiece 12 be damaged or, otherwise identified for out-sorting, the orbit nip roller assembly 20 may be used to re-direct the mailpiece 12 from the input feed path IP to another path. In this embodiment, the secondary roller 72 of the orbit nip roller assembly 20 remains at the first radial position relative to the primary roller 70 to accept and pass the mailpiece from the input feed deck 14 to another module, bin and/or container located at a right angle relative to the input feed path IP.

Registration/Conveyance Apparatus

Figure 8:
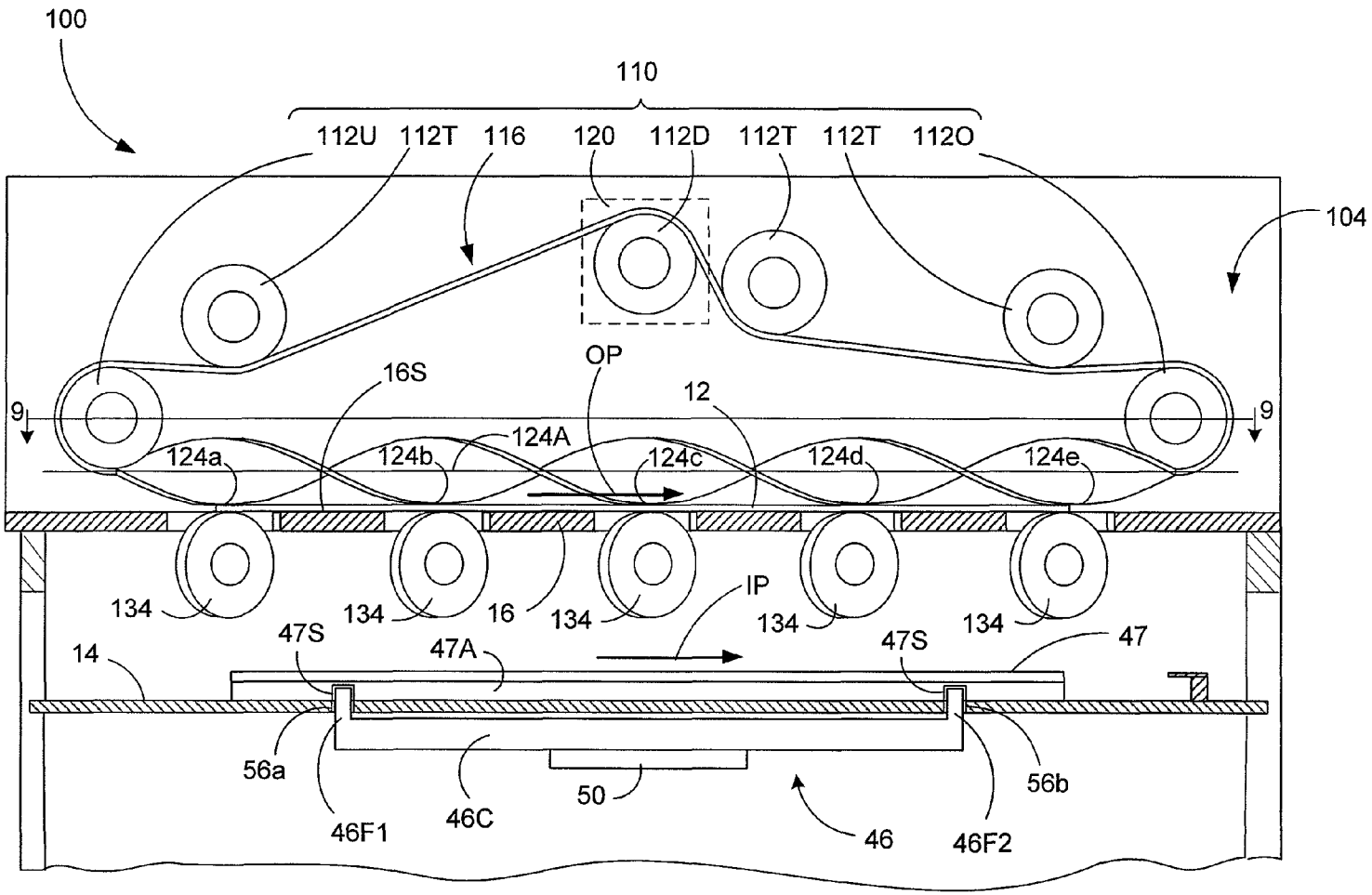
FIG. 8 depicts a front view of the inventive registration/conveyance apparatus including a flexible belt having a twisted belt section for urging mailpieces against a registration member while conveying mailpieces along an output feed path.
Figure 9:
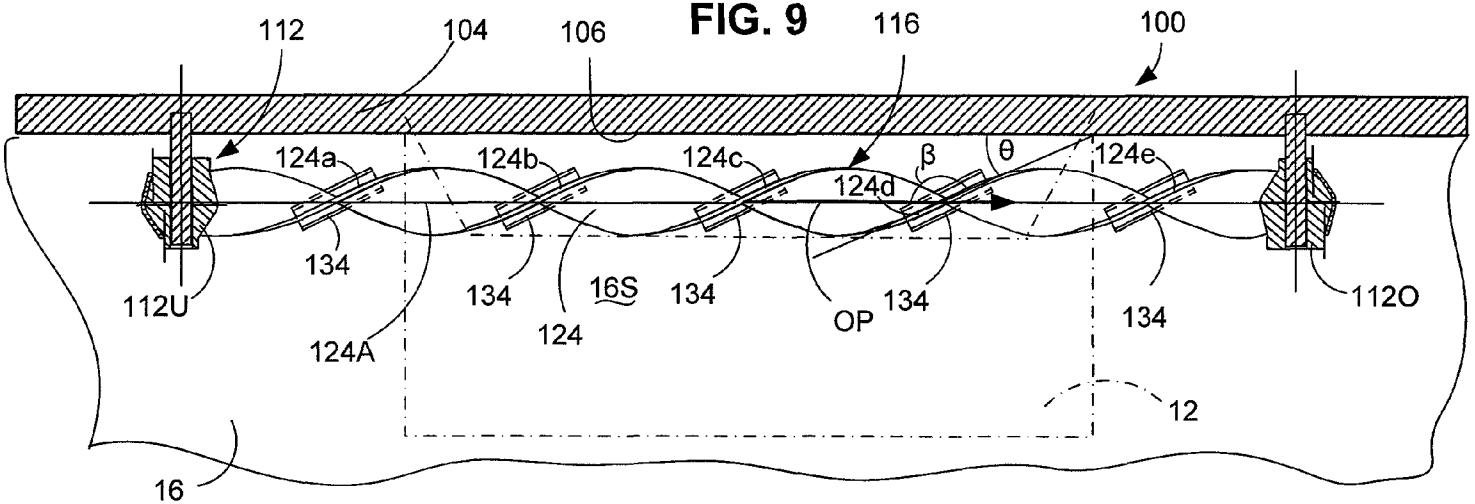
FIG. 9 is a sectional view taken substantially along line 9-9 of FIG. 8 depicting a plurality of spiral edges of the twisted belt section disposed between upstream and downstream rolling elements of the registration/conveyance apparatus.

In FIGS. 1 and 8, the input and output conveyance decks 14, 16 and orbit nip roller assembly 20 are arranged such that a mailpiece 12 is conveyed away from an input feed path IP and returns to an output feed path OP at a substantially right angle. To facilitate return to the output feed path OP, the registration/conveyance apparatus 100 accepts mailpieces 12 received at a right angle relative to the output feed path OP while, furthermore, accepting mailpieces 12 which may significantly vary in thickness.

The registration/conveyance apparatus 100 of the present invention includes a registration member 104 and a conveyance drive mechanism 110. The registration member 104 is integrated with, and disposed adjacent to, the output conveyance deck 16 and projects upwardly from the output conveyance deck 16 to define an abutment surface 106. The abutment surface 106 is operative to align an edge of the mailpiece 12 and guide the mailpiece 12 as it is conveyed along the output feed path OP. The function of the registration member 104 and abutment surface 106 will become evident when discussing the operation of the registration/conveyance apparatus 100.

The drive mechanism 110 is disposed adjacent to the registration member 104 and extends along, i.e., substantially parallel to, the output conveyance deck 16. The drive mechanism 110 further includes at least two rolling elements 112, a continuous flexible belt 116 disposed about the rolling elements 112, and a means 120 for driving the flexible belt 116 around each of the rolling elements 112. In the described embodiment, the flexible belt 116 is disposed about an upstream roller 112U, a downstream roller 112O, several tensioning rollers 112T, and a drive roller 112D. Furthermore, the flexible belt 116 includes a twisted section 124 and an untwisted section 128 (see FIG. 8). The twisted section 124 extends between the upstream and downstream rollers 112U, 112O, i.e., along the output feed path OP of the conveyance deck 16, and defines a plurality of spiral edge segments 124*a*-124*e* which oppose the conveyance deck 16. The untwisted section 128 extends between the upstream and downstream rollers and around the tensioning and drive rollers 112T, 112D.

The twisted section 124 is effected by twisting a length of belt prior to coupling the end portions of the belt 116 to form a continuous loop. The twisted section 124 is produced by limiting the twists within the belt to the length of belt between the upstream and downstream rollers 112U, 1120. The untwisted section 128 is produced by allowing the remaining flat portion of the belt to extend around and between the tensioning and drive rollers 112T, 112D. In the described embodiment, the twisted belt section 124 includes at least two (2) revolutions of twist to produce four (4) spiral edge segments. Although, to enhance the frictional engagement between the spiral edge segments 124*a*-124*e* and the mailpiece 12, the twisted belt section 124 preferably includes at least two and one half (2½) revolutions of twist to produce five (5) spiral edge segments 124*a*-124*e*.

In FIG. 8, each of the spiral edge segments 124*a*-124*e* define an acute angle θ with respect to the abutment surface 106 of the registration member 104. Furthermore, the spiral edge segments 124*a*-124*e* define an obtuse angle β with respect to the output feed path OP. In the illustrated embodiment, the acute angle θ is within a range of about ten (10) degrees to about thirty (30) degrees and the obtuse angle β is within a range of about one-hundred and fifty (150) degrees to about one-hundred and seventy (170) degrees. Preferably, the acute angle θ is within a range of about twenty (20) degrees to about twenty-five (25) degrees and the obtuse angle β is within a range of about one-hundred and sixty (160) degrees to about one-hundred and sixty-five (165) degrees. The relevance of these angles will become apparent when describing the operation and function of the flexible belt 116.

In the described embodiment, the flexible belt 116 is fabricated from a high friction, low elongation, urethane material. Preferably, the urethane material has strain properties which limit elongation to ten percent (10%) of the original length when a maximum allowable stress is imposed. Such properties serve to mitigate creep within the urethane material, maintaining tension in the belt to prevent the flexible belt 116 from "walking" off the upstream and downstream rollers 112U, 112O. Furthermore, the continuous flexible belt 116 has a width dimension of at least three tenths of one inch (0.30") to provide lateral stability with respect to the rollers 112U, 112O and to accommodate sheet material of varying thickness. Preferably, the continuous flexible belt 116 has a width dimension of at least four tenths of one inch (0.40").

Figure 10:
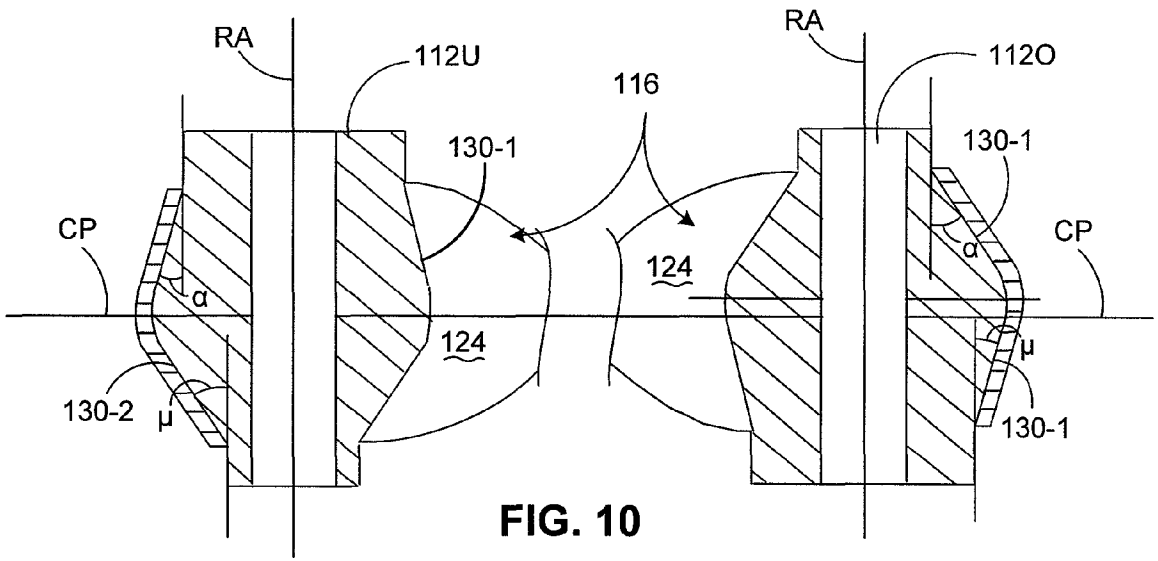
FIG. 10 is a partially broken-away section view of the upstream and downstream rollers depicting the external shape of each for optimal retention of the flexible belt.

To further ensure that the belt 116 is securely retained around each of the rollers 112U, 112O, in FIG. 10, the rollers 112U, 112O each have a unique surface contour which compliment the twist configuration of the flexible belt 116. More specifically, each of the upstream and downstream rollers 112U, 112O defines a center plane CP which bisects, and is normal to, the rotational axis RA of the respective rolling element. Furthermore, the peripheral surface 130-1,130-2, to each side of the center plane CP produces a substantially conical shape which defines cone angles α, μ relative to the rotational axis RA.

To mitigate the loads on the continuous belt 116 and facilitate conveyance of the mailpiece 12 along the output feed path OP, various friction reducing elements may be introduced in combination with the registration/conveyance apparatus 100. For example, a channel (not shown) may be machined or bored into the conveyance deck 16 to prevent the spiral edge segments 124*a*-124*e* from wearing the twist section 124 of the belt 116. Alternatively, a plurality of angled rollers 134 (see FIG. 8) may be disposed in opposing relation to the spiral edge segments 124*a*-124*e* to minimize friction loads and facilitate movement of mailpieces 12 along the output feed path OP.

In the broadest sense of the invention, the cone angle α on one side of the center plane CP is greater than the cone angle μ on the other side of the center plane CP. Furthermore, the cone angles α, μ associated with the upstream roller 112U are reversed relative to the cone angles α, μ associated with the downstream roller 112O. Such reversal is due to the direction and severity of the twist as the flexible belt 116 wraps around the upstream and downstream rollers 112U, 112O. That is, the inboard portion of the upstream roller 112U, i.e., opposing the registration member 104, compliments the contour of the twisted belt section 116 as it moves away from the upstream roller 112U. Similarly, the outboard portion of the upstream roller 112U, i.e., disposed distally or away from the registration member 104, compliments the contour of the twisted belt section 116 as it approaches the downstream roller 112O.

In the preferred embodiment, the cone angle α on one side of the center plane CP is within a range of about fifteen (15) degrees to about thirty five (35) degrees and the cone angle μ on the other side of the center plane is within a range of about forty (40) degrees to about sixty (60) degrees.

In operation, mailpieces 12 are accelerated from the orbit nip roller assembly 20, across the output conveyance deck 16, and under the twisted belt section 124 of the registration/conveyance apparatus 100. Inasmuch as the twisted belt section 124 is flexible, mailpieces 12 may enter at a right angle relative to the elongate axis 124A of the twisted belt section 124. Furthermore, the flexibility of the twisted belt section 124 allows mailpieces 12 to enter which vary in thickness. In the embodiment described herein, mailpieces 12 from between about one-tenth inches (1/10") to about three-quarters inches (¾") in thickness may be placed between the twisted belt section 116 and the support surface 16S of the conveyance deck 16. As the mailpiece 12 moves under the twisted belt section 124, the spiral edge segments 124*a*-124*e* frictionally engage a face surface of the mailpiece 12 to urge the mailpiece 12 toward the abutment surface 106 and convey the mailpiece 12 along the output feed path OP. Inasmuch as the spiral edge segments 124*a*-124*e* form a shallow angle, i.e., acute angle θ, with respect to the registration member 104, and a steep angle, obtuse angle β, with respect to the output feed path OP, the speed or velocity of the mailpiece 12 is greater along the length, or elongate axis 124A of, the twisted belt section 124 than in a transverse direction, i.e., toward the abutment surface 106.

Heretofore, the description has emphasized the structural components and assemblies of the sheet inversion and registration/conveyance apparatus 10, 100. However, it should be appreciated that the drive assemblies and actuators therefore, e.g., the belt drive assemblies BD1, BD2, 110 and LVDT 40, associated with the primary roller 70, carriage assembly 74, conveyance belt 116, and pusher bar 46, will be synchronized, activated and driven by a controller 140 (see FIG. 1). The controller 140 may be integrated with an input/output device (not shown) which is operative to accept commands of, and display information to, a system operator. For example, an operator may input information concerning the size of mailpieces being handled to control the location and timing of the actuation mechanism 40. This information will also determine the rotational speed/direction of the primary roller 70 and the displacement timing of the carriage assembly. It may also determine the speed of the drive mechanism 110 for driving the conveyance belt 116.

In summary, several inventive apparatus and methods have been described hereinabove. These include (i) an apparatus for altering the spatial orientation and/or re-directing sheet material (ii) a method for controlling sheet material as it changes orientation, i.e., varying the position of the sheet material relative to the roller nip to facilitate delivery to an output feed path or another module of a sheet handling system, and (iii) a registration/conveyance apparatus to align and convey sheet material along a conveyance deck. While these apparatus and control methods have been described in the context of a single integrated sheet handling device, it should be appreciated that each maybe be used independently or in combination with other sheet handling and/or processing equipment.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. An apparatus for registering sheet material while being conveyed along a feed path, comprising:

a conveyance deck for conveying sheet material along a support surface;

a registration member disposed adjacent the deck and defining an abutment surface operative to align an edge of the sheet material as the sheet material is conveyed along the support surface of the conveyance deck; and a conveyance drive mechanism disposed adjacent to the registration member and along the conveyance deck, the drive mechanism including:

at least two rolling elements, a continuous flexible belt disposed about and supported by the rolling elements, a section of the belt extending along the feed path and being twisted about an elongate axis of the flexible belt, the twisted belt section, defining a plurality of spiral edge segments;

a means for driving the flexible belt about the rolling elements, wherein the spiral edge segments frictionally engage a surface of the sheet material to urge the sheet material against the abutment surface and convey the sheet material along the support surface of the conveyance deck; and an idler roller opposing each of the spiral edge segments of the twisted belt section, each idler roller rotationally mounting below the support surface and having a peripheral surface portion extending through an aperture of the conveyance deck, the idler rollers operative to reduce frictional wear along each of the spiral edge segments and facilitate transport of the sheet material along the feed path.

2. The apparatus according to claim 1 wherein the conveyance deck supports the sheet material along a face surface and the spiral edge segments engage the sheet material along an opposing face surface to register and convey the sheet material along the feed path.

3. The apparatus according to claim 1 wherein the spiral edge segments define an acute angle θ with respect to the abutment surface of the registration member and an obtuse angle β with respect to the feed path of the sheet material.

4. The apparatus according to claim 3 wherein the acute angle θ is within a range of about ten (10) degrees to about thirty (30) degrees and wherein the obtuse angle β is within a range of about one-hundred and fifty (150) degrees to about one-hundred and seventy (170) degrees.

5. The apparatus according to claim 3 wherein the acute angle θ is within a range of about twenty (20) degrees to about twenty-five (25) degrees and wherein the obtuse angle β is within a range of about one-hundred and sixty (160) degrees to about one-hundred and sixty-five (165) degrees.

6. The apparatus according to claim 1 wherein the twisted belt section includes at least two (2) revolutions of twist to produce four (4) spiral edge segments.

7. The apparatus according to claim 1 wherein the twisted belt section includes at least two and one half (2½) revolutions of twist to produce five (5) spiral edge segments.

8. The apparatus according to claim 1 wherein at least one of the rolling elements defines a center plane which bisects, and is normal to, the rotational axis of the at least one rolling element, and wherein the peripheral surface to each side of the center plane produces a substantially conical shape defining a cone angle relative to the rotational axis, the cone angle on one side of the center plane being greater than the cone angle on the other side of the center plane.

9. The apparatus according to claim 8 the cone angle on one side of the center plane is within a range of about a range of about fifteen (15) degrees to about thirty five (35) degrees and wherein the cone angle on the other side of the center plane is within a range of about forty (40) degrees to about sixty (60) degrees.

10. The apparatus according to claim 8 wherein the rolling elements at each end of the twisted belt section define an upstream rolling element and a downstream rolling element, and wherein the cone angles of the upstream rolling element are reversed relative to the cone angles of the downstream rolling element.

11. The apparatus according to claim 10 wherein the cone angle disposed proximal to the registration member of the upstream rolling element is substantially equal to the cone angle disposed distally from the registration member of the downstream rolling element.

12. The apparatus according to claim 1 wherein the rolling elements rotate about axes which are substantially orthogonal to the feed path and parallel to the support surface and wherein each of the rolling elements mounts to the registration member by an stub shaft projecting outwardly toward and vertically above the feed path of the sheet material.

13. The apparatus according to claim 1 wherein the idler rollers are banked at an angle a relative to the registration member which corresponds to the acute angle θ of each spiral edge surface.

14. The apparatus according to claim 1 wherein the continuous flexible belt is composed of a urethane material having strain properties which limit elongation to ten percent (10%) when under a maximum allowable stress.

15. The apparatus according to claim 1 wherein the continuous flexible belt has a width dimension of at least three tenths of one inch (0.30") to accommodate sheet material of varying thickness.

16. The apparatus according to claim 1 wherein the continuous flexible belt has a width dimension of at least four tenths of one inch (0.40") to accommodate sheet material of varying thickness.

* * * * *